US005417251A

United States Patent [19]

Josefsson et al.

[11] Patent Number: 5,417,251

[45] Date of Patent: May 23, 1995

[54] PROGRAMMABLE WEFT INSERTION BRAKE FOR LOOMS

[75] Inventors: Paer Josefsson, Borås; Kurt A. G. Jacobsson; Lars H. G. Tholander, both of Ulricehamn, all of Sweden

[73] Assignee: IRO AB, Ulricehamn, Sweden

[21] Appl. No.: 211,349

[22] PCT Filed: Sep. 23, 1992

[86] PCT No.: PCT/EP92/02204

§ 371 Date: Jun. 6, 1994

§ 102(e) Date: Jun. 6, 1994

[87] PCT Pub. No.: WO93/06279

PCT Pub. Date: Apr. 1, 1993

[30] Foreign Application Priority Data

Sep. 23, 1991 [DE] Germany ..... 41 31 652.5

[51] Int. Cl.[6] ..... D03D 47/34

[52] U.S. Cl. ..... 139/450; 139/194; 139/435.2

[58] Field of Search ..... 188/65.1, 65.2; 139/450, 194, 370.2, 435.2

[56] References Cited

U.S. PATENT DOCUMENTS

| | | | |
|---|---|---|---|
| 2,202,323 | 5/1940 | Sullivan . | |
| 3,408,832 | 11/1968 | Abe et al. . | |
| 3,633,711 | 1/1972 | Pfarrwaller . | |
| 5,050,648 | 9/1991 | Pezzoli | 139/450 |
| 5,179,980 | 1/1993 | Hubner et al. | 139/194 X |

FOREIGN PATENT DOCUMENTS

| | | |
|---|---|---|
| 0155431 | 9/1985 | European Pat. Off. . |
| 0356380 | 2/1990 | European Pat. Off. . |
| 0467059 | 1/1992 | European Pat. Off. . |
| 0475892 | 3/1992 | European Pat. Off. . |
| WO91/05728 | 5/1991 | WIPO . |

*Primary Examiner*—Andrew M. Falik

*Attorney, Agent, or Firm*—Flynn, Thiel, Boutell & Tanis

[57] ABSTRACT

A jet loom with a weft yarn insertion brake contains a braking element that is movable from a position of rest, on one side of the weft yarn, across the path of the weft yarn to a braking position. An electric motor, which drives the braking element, can be actuated during each insertion process of the loom. The electric motor preferably constitutes a fast response step or d.c. motor, whose direction of displacement can be switched and whose stroke can be individually adjusted for each set position of the braking element during the insertion process. Operation of the electric motor is controlled by an electronic control device. Programming within the control device can be modified between varying insertion processes so as to adapt the timing, stroke and driving direction of the electric motor. The driving force of the electric motor is transferred to the braking element by a constrained, inelastic link connecting the two. The electric motor is controlled so that the driving force exerted on the braking element is always greater in magnitude than the greatest possible reaction force of the deflected weft yarn.

20 Claims, 2 Drawing Sheets

PROGRAMMABLE WEFT INSERTION BRAKE FOR LOOMS

FIELD OF THE INVENTION

The present invention refers to a loom with a programmable insertion brake.

DESCRIPTION OF THE PRIOR ART

An air-jet loom according to EP-A1-03 56 380 includes a driving motor of the controlled insertion brake (e.g. a solenoid plunger for displacing a braking element) which, in its braking position, deflects the weft yarn and reroutes it at two stationary rerouting elements. For damping tension peaks in the weft yarn, the deflection is at least partially eliminated, with the amount of elimination of the deflection being adjusted or controlled. For adjusting and controlling the elimination of the yarn deflection in the insertion brake, which is controlled such that it occupies the braking position until the insertion process has been finished, an elastically yielding energy accumulator is utilized. The energy accumulator is constructed such that it yields with a certain delay to the force exerted due to the rerouting of the weft yarn. The said energy accumulator may be a magnet or a spring whose excitation is controlled so that it will be stronger for initial braking and weaker for the subsequent damping when the deflection is being eliminated. For damping the tension peaks, the force in the deflected weft yarn, which increases when the tension increases, is used for deforming the energy accumulator, which dissipates energy and reduces tension peaks in a reciprocal action. Even if the insertion brake acts on the weft yarn only for the period of time actually required for braking and damping, the elastic energy accumulator will, after the reduction of a tension peak, generate a countermovement with a new tension peak in the weft yarn and with a retraction movement of the weft yarn into the shed. It follows that, in the case of this elastic damping, an additional interference is induced at the end of the insertion process because of the active participation of the weft yarn. Moreover, a jolt perceptible in the weft yarn as well as noticeable mechanical wear in the insertion brake are caused due to the fact that the insertion brake is moved so that it strikes a stop means.

In an air-jet loom according to EP-A1-01 55 431, a cam-controlled insertion brake is provided. A deflection lever of the insertion brake is pivoted relative to stationary rerouting elements by a cam drive in accordance with a program which is identical for all insertion processes and which has to be carried out completely during each insertion process. The insertion brake occupies a braking position at the beginning of the insertion process and is gradually moved to its position of rest when the weft yarn is starts to move for the purpose of insertion. Towards the end of the insertion process, the insertion brake is readjusted to a braking position where it will remain with increasing deflection of the weft yarn until the next insertion process takes place. However, a mechanically controlled insertion brake is not precise enough for being used with modern jet looms having high insertion speeds and a high insertion frequency.

EP-A1-01 55 431, which has a prior time rank, discloses the measures of pressing a brake pap, which is arranged on a bent lever and which is controlled via a lever mechanism, onto a countersurface and of decelerating by means of clamping the yarn passing through. The lever mechanism is driven via a stepper motor with a resolver, in accordance with the gripper movement, thus generating a specific braking force curve for the yarn. The stepper motor is controlled by programmed instructions outputted by a logic circuit.

EP-A1-04 67 059, which has a prior time rank, discloses a yarn tension regulating device also adapted for use with jet looms. It is provided with a two-armed oscillating lever whose one end deflects the yarn guided across two stationary abutments, whereas the other end thereof carries a magnet coil which is in alignment with two spaced permanent magnets of a linear electric motor. In a normal position of the lever, in which the yarn is deflected, the two permanent magnets produce an effect like a spring. When the yarn tension changes, the changing deflection of the lever is compensated for by the current supplied to the linear electric motor in such a way that the force exerted by the lever onto the yarn is brought into equilibrium with the force caused by the yarn tension. The instantaneous yarn tension is calculated on the basis of the amount of current which has to be supplied to the linear electric motor for establishing this equilibrium. Moreover, it is also possible to actuate the linear electric motor for further deflection of the yarn by means of the lever so as to draw back the yarn after an insertion process or in the middle of a process in the course of which the yarn is inserted in a rapier loom.

U.S. Pat. No. 2,202,323 discloses a yarn tensioner which, by means of an applied weight, deflects the yarn from a straight path more than once. The produced braking effect on the yarn depends exclusively on the weight applied. In the case of a tension drop, e.g. after yarn breakage, the yarn tensioner is, due to a weight applied, displaced to a position in which an electric contact is actuated and a switch-off signal is produced.

U.S. Pat. No. 3,633,711 discloses a yarn brake with rerouting and deceleration of the yarn at several points between brake pads acting like a pair of tongs, said yarn brake being adapted to be controlled by a cam drive or a magnet.

SUMMARY OF THE INVENTION

It is the object of the present invention to provide a loom of the type mentioned above with an insertion brake which is universally usable and which permits optimization of the insertion processes and a reduction of the number of yarn breakages in combination with a high insertion speed and a high insertion frequency.

The objective of the present invention is achieved by means of a programmable insertion brake, which can precisely control and reduce the increased tension within the weft yarn that occurs during the end of the insertion process of the loom. By moving the insertion brake in the opposite direction, the length of the weft yarn section previously stored in the insertion brake can be, at least partially, resupplied during the tension reduction stage, thereby counteracting the subsequent and undesirable increase in tension and withdrawal of weft yarn. A stepping or d.c. motor displaces the braking element in a manner which is strictly dependent upon the control program, the weft yarn being at no time capable of automatically effecting a modification or elimination of the rerouting, unless such modification or elimination is forced upon or offered to the weft yarn by the braking element. In view of the fact that an elastic component is missing, the deceleration of the weft yarn and the reduction of tension within the yarn is carried out exclusively by means of the programmed control of the insertion brake, said control being between insertion processes or even during an insertion process. A hard jolt at the end of the displacement of the insertion brake is avoided, since said insertion brake does not strike a stop means. Instead, it is precisely controlled by means of cams with respect to its acceleration, deceleration and reversal of its direction of movement. This results in a minimum amount of mechanical wear to the active components. In view of the fact that the control of the insertion brake is effected electronically, exact reproducible control processes can be carried out in critical phases which last only for a few milliseconds. An adaptation to varying operating conditions of the loom can be carried out just as an adaptation to the respective yarn quality, or to insertion speeds which may vary for the same weft yarn. In view of the fact that this structural design guarantees that the insertion brake works according to the program in question without any influence on the part of the weft yarn, a self-learning, adaptive control system can be realized by processing additional information in the control device, which normally includes a microprocessor. This type of control system can, to a very large extent, guarantee an optimized insertion processes, i.e. each insertion process is finished with a properly stretched and undamaged weft yarn within the period of time predetermined by the loom and the weft yarn is treated in said insertion process so carefully that the number of yarn breakages will be reduced.

BRIEF DESCRIPTION OF THE DRAWINGS

Embodiments of the subject matter of the invention are explained on the basis of the drawing, in which.

DETAILED DESCRIPTION

Figure 1:
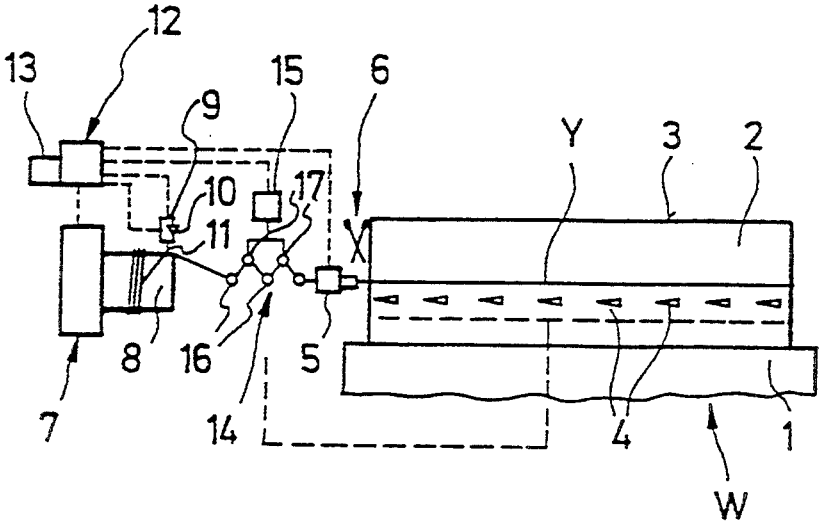
FIG. 1 shows a schematic representation of an air-jet loom with a weft yarn feeder at the end of an insertion process.

A loom W according to FIG. 1 is an air-jet loom 1 provided with a shed 2 and a reed 3. Sections of a weft yarn are inserted into the shed 2 in accordance with the operating cycle of the loom; at least one main nozzle 5 and, along the shed 2, auxiliary nozzles 4 are provided for transporting the weft yarn sections; said nozzles being activated and deactivated in accordance with the operating cycle of the loom. A cutting device 6 is provided downstream of the main nozzle. The weft yarn Y is drawn off a weft yarn feeder 7 which keeps a plurality of turns at a stand-by position on a storage body 8. The yarn feeder 7 has provided therein a stopping device 9 with a stopping element 11 which is retracted for releasing a weft yarn section of exactly measured length and which is returned to the stopping position shown when the weft yarn section has been drawn off. Furthermore, a passage sensor 10 is provided near the stopping device 9, said passage sensor 10 producing a passage signal whenever the weft yarn passes during the insertion process and transmitting said passage signal to a control device 12 which controls, among other components, also the stopping device 9. A programming part 13 of a control circuit is provided near the control device 12, said programming part 13 serving to control a weft yarn insertion brake 14, which is arranged downstream of the weft yarn feeder 7, during each insertion process. The insertion brake 14 is provided with a driving motor 15 for movable braking elements 17, which are adapted to be displaced relative to stationary rerouting elements 16. A driving motor proven to be particularly useful in practice is an escap stepping motor, type P 430, with a winding in series or a winding in parallel and with a torque of up to 80 Nmm and up to 10,000 steps per second.

In FIG. 1, an insertion process has been finished. The weft yarn Y has reached the shed end lying opposite the yarn feeder. The insertion brake 14 decelerated the weft yarn toward the end of the insertion process. The stopping element 11 is in the stopping position. The next step is that the inserted weft yarn is cut and beaten up by the reed 3. Subsequently, a new insertion process is initiated by the main nozzle 5 and the stopping element 11 is retracted again. The insertion brake 14 can be moved to its position of rest where it permits free passage of the weft yarn Y.

Figure 2:
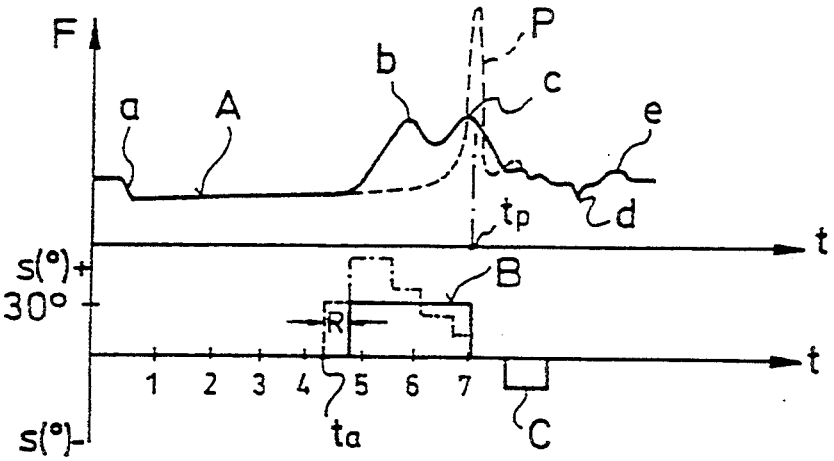
FIG. 2 shows a diagram for elucidating the insertion process.

The diagram of FIG. 2 clearly shows, in the upper part thereof, an insertion process on the basis of the tension behavior of the weft yarn Y. Curve A, which consists of a solid line, represents the tension behaviour achieved by use of the controlled insertion brake 14. The part P of the curve consisting of a broken line represents a tension peak of the type occurring at the end of the insertion process due to a stretching or whipping effect in the weft yarn stopped by the stopping element 11. This tension peak is to be reduced because it interferes with the insertion process and is dangerous to the weft yarn (weft yarn breakage). The tension drop a at the beginning of the curve A represents the start of movement of the weft yarn at the beginning of the insertion process as soon as the stopping element 11 has released the weft yarn. Following this, the weft yarn is accelerated until it has reached its insertion speed, the tension behaviour being comparatively constant in this area. Towards the end of the insertion process, viz. a certain period of time prior to the expected occurrence of the tension peak P at the moment tP, the insertion brake 14 is moved to its braking position so that the weft yarn will be deflected and rerouted and decelerated by means of friction. This will cause a first increase in tension b and a second increase in tension C which is approximately time-coincident with the tension peak P. Subsequently, the tension decreases before a small, significant tension drop d represents the cutting of the weft yarn and before an increase in tension e finally represents the beating up by the reed. The time required for an insertion process is shown on the horizontal axis, whereas the vertical axis indicates, in the upward direction, the tension in the weft yarn.

The passage signals No. 1–7 of the passage sensor 10, which occur by way of example during an insertion process, can be seen on the lower horizontal time axis in FIG. 2. Without any braking, the tension peak P would occur during each insertion process in a fixed temporal relationship with a passage signal, e.g. passage signal No. 7. The control of the insertion brake 14 is therefore related to the passage signals so as to permit the insertion brake to be moved in the opposite direction by means of the control device 12 in due time. Curve B represents the movement of the insertion brake 14 for a predetermined period of time and with a positive magnitude of a deflection stroke e.g. an angular stroke of 30°. The front part of curve B, which consists of a broken line, clearly shows the response time R of the insertion brake 14. In order to achieve a movement of the insertion brake 14 over the area represented by the solid-line curve B, the brake has to be activated at the moment ta after the passage signal No. 4. The curve, which consists of a dot-dash line and which is superimposed on the solid-line curve B, shows clearly that also the control of the insertion brake 14 can be varied, e.g. in a steplike manner, for achieving first an abrupt and intensive deceleration with strong rerouting and deflection of the weft yarn and for reducing afterwards the rerouting and the deflection to a certain extent, along with releasing the weft yarn stored in the insertion brake 14 so as to counteract an undesired increase in the tension of the weft yarn, so as to have the weft yarn in the shed in a stretched condition, the stretching being effected by the then additionally activated last auxiliary nozzles 4. When the passage signal 4 has occurred, the control device 12 will wait for the moment ta prior to activating the insertion brake 14.

Curve C, which consists of a solid line, represents e.g. a movement of the insertion brake 14 beyond the position of rest into the other direction, e.g. for activating (as will be explained later on) a threading nozzle for automatic threading of a weft yarn or a nozzle of the insertion brake.

Figure 3A:
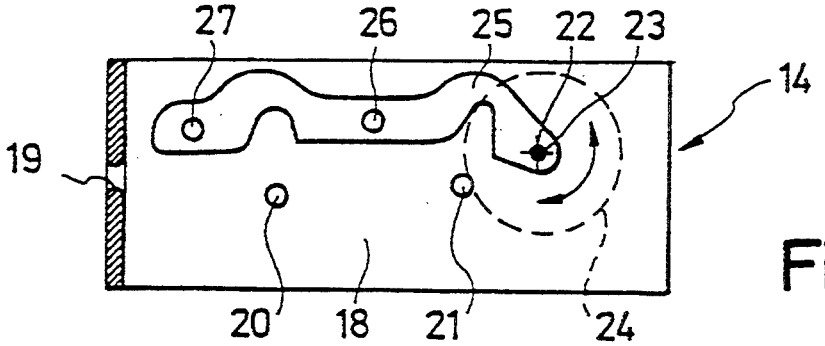
FIG. 3A,3B show two associated fragmentary sections of a first embodiment of an insertion brake.
Figure 3B:
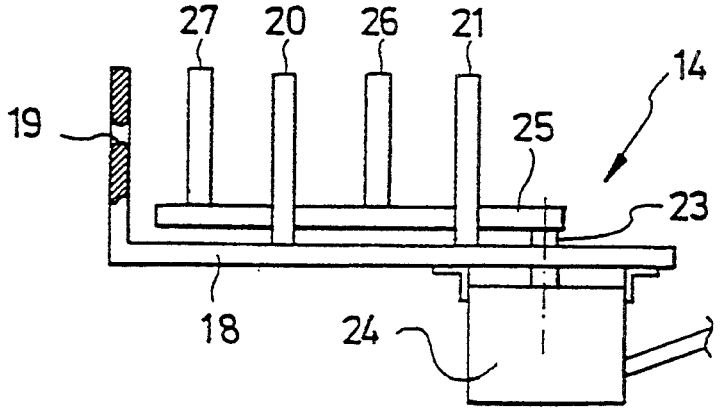

The insertion brake 14 according to FIG. 3A and 3B comprises a basic body 18 at which a stationary rerouting point 19 is defined by an eyelet. Two spaced stationary rerouting elements in the form of pins, 20 and 21, are secured to the basic body 18 on one side of the path of the weft yarn through the insertion brake 14. Furthermore, a carrier 25 for two movable braking elements 26 and 27 is adapted to be rotated on the basic body about a vertical adjustment shaft 22. The carrier 25 is constructed as an inelastic lever, and it is connected to a driving motor 24 via an inelastic connection shaft 23, thereby assuring a slack-free coupling between the drive motor and brake element. The driving motor 24 is arranged below the basic body 18, and driving motor 24 is a fast-response stepping motor or d.c. motor; it will be expedient to provide said stepping motor or d.c. motor with a resolver for determining the rotary or angular movement of the motor shaft.

As soon as the driving motor 24 is moved from its position of rest, as shown in FIG. 3A, in a counterclockwise direction through the control device 12 within the framework of the program for controlling the insertion brake 14, the braking elements 27 and 26 will pass between the stationary rerouting elements 19, 20 and 21 and move across the yarn path. The weft yarn will be rerouted and deflected as well as decelerated. At the same time, a yarn section whose length depends on the geometry of the individual elements and the stroke of the driving motor 24 will be stored in the insertion brake 14. As soon as the braking process has been finished, the driving motor 24 will again be moved in the opposite direction, either with a predetermined stroke or fully up to its position of rest. In addition, a clockwise control movement of the driving motor 24 in FIG. 3A, in accordance with curve C in FIG. 2, is also possible for displacing the movable braking elements 26, 27 even farther than the position of rest and for initiating a different function.

Figure 4A:
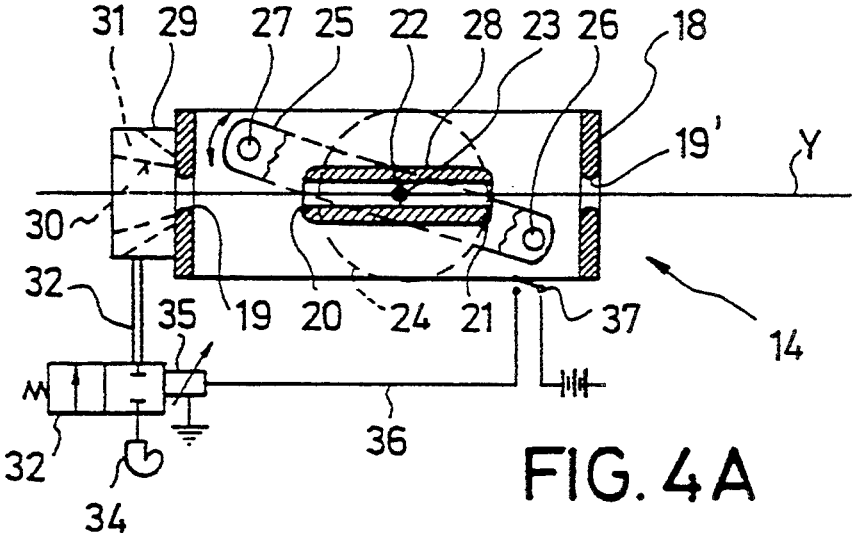
FIG. 4A,4B show two associated fragmentary sections of an additional embodiment of an insertion brake.
Figure 4B:
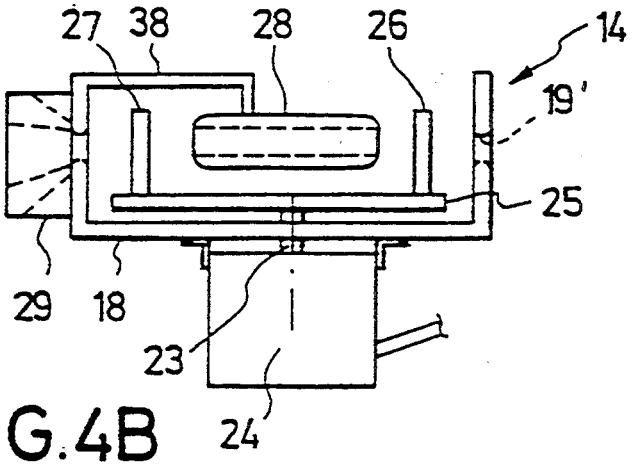

In the case of the embodiment of the insertion brake 14 according to FIG. 4A and 4B, a total number of six rerouting points for the weft yarn is provided. In this embodiment, expediency is maximized when an overall rerouting angle of up to 700° is achieved. The two stationary rerouting elements 19 and 19', which are defined by eyelets, are provided on the basic body 18 in the weft yarn path. Two inner stationary rerouting points 20 and 21 are formed at a tube 28 held coaxially with the weft yarn path by means of a component 38 of the basic body. The movable braking elements 26 and 27 are attached to their lever-like carrier 25 and adapted to be rotated together therewith about the central adjustment shaft 22. FIG. 4A represents the position of rest and, with the aid of the drive means 24 and via the connection shaft 23, the carrier 25 is adapted to be moved from said position of rest in a counterclockwise direction for deflecting and decelerating the weft yarn. In the course of this process, the two movable braking elements 26, 27 move across the weft yarn path from opposite sides between the inner stationary rerouting elements 20 and 21 and the outer stationary rerouting elements 19 and 19', respectively.

The part of the basic body 18 where the feed yarn is supplied is provided with a threading nozzle 29 comprising a funnel-shaped inlet 30 for the weft yarn and a nozzle means 31, where compressed air coming from a pressure source 34 can be guided through the insertion brake and the tube 28. The threading nozzle 29 is used for automatically threading the weft yarn after yarn breakage or for the initial threading operation. The threading nozzle 29 is connected via a line 32 to an on-off valve 33, which is adapted to be switched between a passage position and a blocking position by means of a switching magnet 35 and which interconnects the pressure source 34 and the threading nozzle 29 in said passage position. The magnet 35 is connected to a switch 37 via a line 36, said switch 37 being arranged in the area of movement of e.g. the carrier 25 on the insertion brake 14 or in the vicinity thereof. If the carrier 25 is displaced clockwise to a certain extent from its position of rest (in accordance with curve C of FIG. 2), the switch 37 will be closed and the on-off valve 33 will be switched to its passage position. This switching process can be initiated in accordance with the program in question via the control device as soon as said control device has supplied thereto e.g. an error message or a yarn breakage message. The tube 28 supports correct flow guidance during the weft yarn threading process. The on-off valve 33 may also be actuated directly by the carrier 25. If it is constructed as a control valve, the flow through the nozzle 29 can be modulated continuously or in steps by means of the driving motor 24. The tube 28 can be constructed as a secondary stationary main nozzle used for threading and/or for purposefully moving the weft yarn and can be actuated by controlling the driving motor 24 in an adequate manner.

Figure 5:
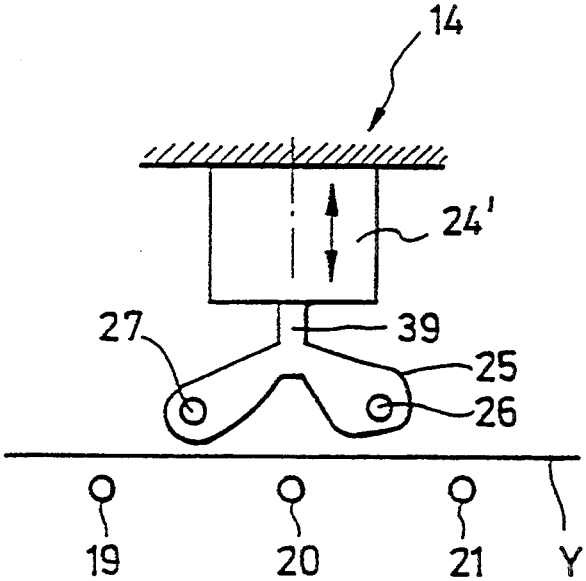
FIG. 5 shows a schematic representation of an additional embodiment of an insertion brake.

In the case of the embodiment according to FIG. 5, the movable braking elements 26, 27 of the insertion brake 14 are adapted to be moved linearly between the stationary rerouting elements 19, 20, 21 for rerouting the weft yarn Y and for deflecting and decelerating it. The braking elements 26, 27 are located on the carrier 25, which, via a slide member 39, is controlled by the driving motor 24' constructed as a linear motor. It will be expedient when the driving motor 24' is a stepping motor or a d.c. motor.

By means of the electronically, cam-controlled insertion brake described above, along with its adaptive control system, the following advantages and important functions are obtained:

An overall low tension is maintained within the weft yarn, from which a considerable reduction in the number of thread breakages or of other insertion faults results.

In view of the fact that, due to the cam control, the weft yarn is less abruptly stopped than in previous systems, and in view of the fact that the weft yarn no longer retracts either, the function of the auxiliary nozzles arranged in the shed can be throttled towards the end of the insertion process, resulting in a lower nozzle pressure combined with a lower consumption of air for cases of filament or broad-width fabric looms.

Due to the fact that the weft yarn is quickly stabilized at the end of the insertion process, it is possible to adjust, after the insertion process, shorter periods of time which will elapse until the shed changes. This will result in a longer period of time which is actually available for transporting the weft yarn. This is achieved without any increase in pressure in the main nozzle, which frequently leads to additional malfunctions.

The insertion brake is, at least, self-compensating, since the use of lower weft yarn speeds and lower tensions has the effect that the frictional force effective during the braking operation is reduced as well.

For the purpose of rapid stabilization of the weft yarn and the end of the insertion process, it is, due to the individual and fast-responding controllability of the insertion brake, possible to move the free weft yarn end to a comparatively advanced position and to draw it then slightly back or to release, after a minor delay, at least part of the weft yarn length stored in the brake.

Furthermore, the insertion brake can be used for repositioning the whole weft yarn length at the end of the insertion process and before the reed beats up, e.g. with respect to an improvement of the means processing the boundary edge of the fabric.

If several weft yarns are processed alternately, the free end of a weft yarn in a stand-by position can be drawn back in the channel so that one fluttering weft yarn end will not interfere with the other weft yarn. This drawing back by means of the controlled insertion brake, or a to-and-fro movement of the weft yarn end in the main nozzle, will distribute the mechanical influence (fibre dissolution) in the case of weft yarn which is not inserted for a prolonged period of time, said mechanical influence being thus reduced to a negligible extent.

Furthermore, by means of a program-dependent displacement of the insertion brake at the beginning of the insertion process, a weft yarn length is released which has been stored previously, i.e. after the end of the preceding insertion process, so that the weft yarn end, supported by the main nozzle or the auxiliary nozzle, will already start its movement before the stopping element in the weft yarn feeder releases the weft yarn. This permits a reduction of the peak velocity of the weft yarn during the insertion process without exceeding the necessary insertion period.

By resupplying the stored weft yarn length in a very rapidly controlled manner after the end of the insertion process and during the beating up of the reed and the cutting operation, respectively, the tension variations resulting from these operations are reduced. For this purpose, the control circuit may have provided therein a special logical driver circuit.

The braking operation is carried out with a complex stroke/time program so that an adaptive control of the weft yarn speed can be achieved. It is, in this connection, possible to control not only a correct maximum stroke of the insertion brake, but to follow a specific position/time diagram for the insertion brake movement in the course of which the insertion brake carries out a plurality of functions at the weft yarn. Since similar type yarn, under unchanged insertion conditions, will move faster towards the end of a supply coil than it did when the supply coil was still full, a weak deflection effected by the insertion brake can throttle the weft yarn speed to the desired value when this part of the yarn is being processed. The insertion brake is, so to speak, an insertion brake that realizes a plurality of braking steps.

A particularly effective reduction of the tension peak at the end of the insertion process is achieved when, in the maximum deflection condition and, consequently, in a condition in which the maximum braking effect is produced, the insertion brake releases the stored yarn length very rapidly, at a speed of up to 20 m/sec, before the weft yarn develops its tendency to spring back. This necessitates the rapid reversal of the direction of movement and the positive connection in the insertion brake as well as a driver logic section in the control program.

In summary, it is seen that an insertion brake with a multi-functional range of use is created by positively connecting a precise and controllable driving motor with the necessary braking elements. Then by including an intelligent and flexible control device, the subsequently formed insertion brake fulfills its main task of damping or suppressing the whipping effect within the weft yarn, along with optimizing the insertion process of the loom.

We claim:

1. A loom provided with an insertion brake for controlling the movement of weft yarn being processed within said loom, comprising:

at least one braking element movably arranged within said insertion brake so as to be displaced across a path of said weft yarn, said braking element moving from a position of rest on one side of said weft yarn to at least one braking position for deflecting and rerouting said weft yarn at rerouting elements arranged in a stationary manner on another side of said weft yarn;

an electric driving motor connected to said braking element by means of a positive connection which is inelastic in all directions of movement, said driving motor adapted to be actuated during each insertion process of said loom and capable of being operated in each direction of movement, a stroke of said driving motor being adjustable in each set position of said braking element during said insertion process of said weft yarn; and a programmable control device for controlling the timing, stroke and direction of movement of said driving motor, the control device having a programming capable of being modified at least at a time between a first and subsequent insertion process of said loom;

wherein a force exerted by said driving motor and acting upon said braking element is greater than a possible maximum reaction force of said deflected weft yarn.

2. A loom according to claim 1, wherein said electric driving motor is one of a fast-response stepping motor and a d.c. motor.

3. A loom according to claim 1, further comprising at least one controllable nozzle located on a yarn-feeding side of said loom and associated with said insertion brake, wherein said nozzle can be activated by said control device and can be modulated in a controlled manner so as to obtain a desired blowing effect.

4. A loom according to claim 1, wherein said programmable control device further includes a driver logic section which allows for a controlled, rapid release of a length of said weft yarn stored in said insertion brake.

5. A loom according to claim 1, wherein said programmable control device further includes program routines for storing a length of weft yarn after an end of said insertion process, and for releasing said stored weft yarn length for an initial acceleration of a leading end of said weft yarn.

6. An insertion brake for a loom, comprising:

at least one braking element movably arranged within said insertion brake so as to be displaced across a path of a weft yarn, said braking element moving from a position of rest on one side of said weft yarn to at least one braking position for deflecting and rerouting said weft yarn at rerouting elements arranged in a stationary manner on another side of said weft yarn;

an electric driving motor connected to said braking element by means of a positive connection which is inelastic in all directions of movement, said driving motor being one of a fast-response stepping motor and a d.c. motor and adapted to be actuated during each insertion process of said loom and capable of being operated in each direction of movement, a stroke of said driving motor being adjustable in each set position of said braking element during said insertion process of said weft yarn; and a programmable control circuit which can be contained within a control device of said loom, said control circuit controlling the timing, stroke and direction of movement of said driving motor, the control circuit having a programming capable of being modified at least at a time between a first and subsequent insertion process of said loom;

wherein a force exerted by said driving motor and acting upon said braking element is greater than a possible maximum reaction force of said deflected weft yarn.

7. An insertion brake according to claim 6, wherein said insertion brake is constructed as a deflection brake, and further comprises a plurality of stationary rerouting elements and a plurality of braking elements which can be moved so as to pass between said stationary rerouting elements, wherein said braking elements are attached to a carrier, and said carrier is attached to said driving motor by means of the positive connection.

8. An insertion brake according to claim 7, wherein said carrier is rotated about an adjustment shaft, and that said adjustment shaft is defined by a connection shaft extending between said driving motor and said carrier.

9. An insertion brake according to claim 8, wherein said connection shaft is rotatably supported in said driving motor.

10. An insertion brake according to claim 7, wherein said deflection brake is provided with at least two stationary rerouting elements and with at least two movable braking elements.

11. An insertion brake according to claim 7, wherein said carrier is adapted to be displaced linearly in a direction transversely to a weft yarn direction, and the positive connection is established between said carrier and said driving motor.

12. An insertion brake according to claim 7, wherein a resolver is incorporated into said control circuit for detecting angular movements of a motor shaft of said driving motor.

13. An insertion brake according to claim 7, wherein said deflection brake is provided with two outer and two inner stationary rerouting elements and with two braking elements adapted to be moved between said outer and said inner rerouting elements, respectively, and that said two braking elements are arranged close to the ends of said carrier, which is centrally rotated about said adjustment shaft, said braking elements being arranged substantially at identical distances from said adjustment shaft.

14. An insertion brake according to claim 7, wherein said insertion brake, when occupying its braking position, has an overall weft yarn rerouting angle of up to 700°.

15. An insertion brake according to claim 13, wherein said two inner stationary rerouting elements are arranged in a tube which is coaxial with said weft yarn path and which forms an air guide passage through which said weft yarn may be reliably threaded.

16. An insertion brake according to claim 15, wherein said tube is constructed as a threading nozzle for controlled threading and acceleration of said weft yarn before said insertion process starts.

17. An insertion brake according to claim 15, wherein a rate of flow through said threading nozzle can be varied during said insertion process, by means of said driving motor of said insertion brake.

18. An insertion brake according to claim 6, wherein an on-off switch for activating a threading nozzle directed towards a path of said weft yarn between said braking and rerouting elements is provided adjacent said insertion brake, said on-off switch being actuated by said driving motor.

19. An insertion brake according to claim 18, wherein said braking element and driving motor, when controlled such that they move from said position of rest in a direction of movement opposite to a direction of said braking positions, are respectively moved to at least one threading position, and that said on-off switch for said threading nozzle is in alignment with a threading position of said braking element and driving motor, respectively, for the purpose of actuation.

20. An insertion brake according to claim 19, wherein a rate of flow through one of said threading nozzle and a secondary main nozzle can be modulated continuously or in steps by means of said driving motor.

* * * * *

UNITED STATES PATENT AND TRADEMARK OFFICE

CERTIFICATE OF CORRECTION

PATENT NO. : 5 417 251

DATED : May 23, 1995

INVENTOR(S) : Paer JOSEFSSON, et al.

It is certified that error appears in the above-indentified patent and that said Letters Patent is hereby corrected as shown below:

Column 10, line 17; change "7" to ---8---.

line 42; delete ",".

Signed and Sealed this

Seventeenth Day of October, 1995

*Attest:*

Bruce Lehman

BRUCE LEHMAN

*Attesting Officer*

*Commissioner of Patents and Trademarks*